US009199451B2

(12) United States Patent
Goden et al.

(10) Patent No.: US 9,199,451 B2
(45) Date of Patent: Dec. 1, 2015

(54) PRINTING ELEMENT SUBSTRATE, PRINTHEAD, AND PRINTING APPARATUS

(71) Applicant: CANON KABUSHIKI KAISHA, Tokyo (JP)

(72) Inventors: Tatsuhito Goden, Machida (JP); Masanobu Ohmura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/319,053

(22) Filed: Jun. 30, 2014

(65) Prior Publication Data

US 2015/0029245 A1 Jan. 29, 2015

(30) Foreign Application Priority Data

Jul. 26, 2013 (JP) ..... 2013-156031

(51) Int. Cl.
*B41J 29/38* (2006.01)
*B41J 2/045* (2006.01)

(52) U.S. Cl.
CPC ..... *B41J 2/0455* (2013.01)

(58) Field of Classification Search
USPC ..... 347/9–10
See application file for complete search history.

(56) References Cited

U.S. PATENT DOCUMENTS

| | | | | |
|---|---|---|---|---|
| 2003/0090546 | A1 | 5/2003 | Mochizuki et al. | |
| 2009/0002457 | A1 | 1/2009 | Sakurai | |
| 2009/0174753 | A1 | 7/2009 | Kurokawa et al. | |
| 2010/0315455 | A1* | 12/2010 | Sakurai | 347/10 |

FOREIGN PATENT DOCUMENTS

| | | | |
|---|---|---|---|
| CN | 1340418 | A | 3/2002 |
| CN | 1535826 | A | 10/2004 |
| CN | 1701961 | A | 11/2005 |
| CN | 1960875 | A | 5/2007 |
| CN | 101203385 | A | 6/2008 |
| EP | 0 997 280 | A2 | 5/2000 |
| JP | 2009-029117 | A | 2/2009 |

OTHER PUBLICATIONS

Chinese Office Action issued in corresponding application No. 201410353850.X dated Aug. 26, 2015- 13 pages with English translation.

* cited by examiner

*Primary Examiner* — Jason Uhlenhake
(74) *Attorney, Agent, or Firm* — Fitzpatrick, Cella, Harper & Scinto

(57) ABSTRACT

A printing element substrate, comprising a printing unit including a printing element and a transistor, a logic circuit unit configured to be supplied with a first power supply voltage and receive print data, a unit configured to be supplied with a second power supply voltage and output a signal from the logic circuit unit to a control terminal of the transistor, a voltage generation unit configured to be supplied with a third power supply voltage and generate the second power supply voltage using the third power supply voltage, and a controlling unit configured to control supply of the third power supply voltage to the voltage generation unit, wherein when the first power supply voltage is not supplied to the logic circuit unit, the controlling unit does not supply the third power supply voltage to the voltage generation unit.

20 Claims, 10 Drawing Sheets

PRINTING ELEMENT SUBSTRATE, PRINTHEAD, AND PRINTING APPARATUS

BACKGROUND OF THE INVENTION

1. Field of the Invention

The present invention relates to a printing element substrate, a printhead, and a printing apparatus.

2. Description of the Related Art

Japanese Patent Laid-Open No. 2009-29117 describes an inkjet printing apparatus represented by a printer or the like. The inkjet printing apparatus includes a printhead for executing printing on a printing medium. The printhead includes a printing element substrate. The printing element substrate includes a printing unit for executing printing, a processing unit for processing print data, a level shifter for performing the level shift of an active signal from the processing unit, and outputting the signal to the printing unit, and a voltage generation unit for generating a voltage to be used by the level shifter to perform a level shift. The printing unit includes a printing element and a driving transistor for driving the printing element.

A plurality of different power supply voltages are supplied to the printing element substrate. The processing unit uses a power supply voltage for a logic circuit. The printing unit uses a power supply voltage for driving the printing element. Furthermore, the voltage generation unit uses a power supply voltage for generating a voltage to be supplied to the level shifter.

When the order of supply of the plurality of power supply voltages is wrong or the printhead is not appropriately mounted, only some of the plurality of power supply voltages may be supplied. For example, not the power supply voltage for the logic circuit but other power supply voltages may be supplied. In this case, since the potential of the power supply node of the logic circuit is indefinite, this may cause, for example, an operation error of the printing unit. Furthermore, a current (for example, a through current) generated when the potential of the power supply node of the logic circuit is indefinite may increase the power consumption.

Note that Japanese Patent Laid-Open No. 2009-29117 discloses an arrangement in which when no power supply voltage for the logic circuit is supplied to the printing apparatus, the drive transistor for receiving a signal from the level shifter is rendered non-conductive by prohibiting supply of a voltage to the level shifter, thereby preventing an operation error of the printing unit. The arrangement described in Japanese Patent Laid-Open No. 2009-29117, however, does not consider the current of the voltage generation unit for generating a voltage to be supplied to the level shifter.

SUMMARY OF THE INVENTION

The present invention provides a technique advantageous in reducing the power consumption while decreasing the probability of an operation error of a printing element substrate when a power supply voltage is not appropriately supplied.

One of the aspects of the present invention provides a printing element substrate, comprising a printing unit including a printing element and a transistor configured to drive the printing element, a logic circuit unit configured to be supplied with a first power supply voltage, and receive print data, a unit configured to be supplied with a second power supply voltage, and output a signal from the logic circuit unit to a control terminal of the transistor, a voltage generation unit configured to be supplied with a third power supply voltage, and generate, using the third power supply voltage, the second power supply voltage to be supplied to the unit, and a controlling unit configured to control supply of the third power supply voltage to the voltage generation unit, wherein when the first power supply voltage is not supplied to the logic circuit unit, the controlling unit does not supply the third power supply voltage to the voltage generation unit.

Further features of the present invention will become apparent from the following description of exemplary embodiments with reference to the attached drawings.

DESCRIPTION OF THE EMBODIMENTS (Example of Arrangement of Printing Apparatus)

An example of the arrangement of an inkjet printing apparatus will be described with reference to FIGS. 1A and 1B. The printing apparatus may be a single-function printer having only a printing function, or a multi-function printer having a plurality of functions such as a printing function, FAX function, and scanner function. Furthermore, the printing apparatus can include a manufacturing apparatus for manufacturing a color filter, electronic device, optical device, microstructure, or the like by a predetermined printing method.

Figure 1A:
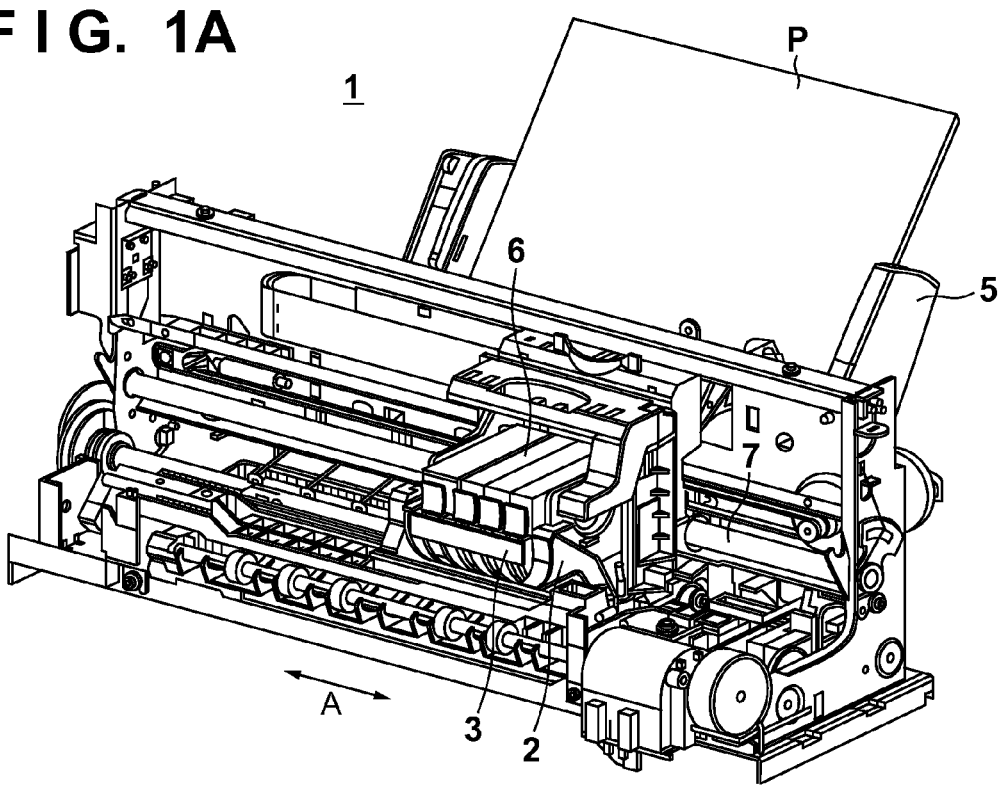
FIGS. 1A and 1B are views for explaining an example of the arrangement of a printing apparatus.

FIG. 1A is a perspective view showing an example of the outer appearance of a printing apparatus PA. In the printing apparatus PA, a printhead 3 for discharging ink to execute printing is mounted on a carriage 2, and the carriage 2 reciprocates in directions indicated by an arrow A to execute printing. The printing apparatus PA feeds a printing medium P such as printing paper via a sheet supply mechanism 5, and conveys it to a printing position. At the printing position, the printing apparatus PA executes printing by discharging ink from the printhead 3 onto the printing medium P.

In addition to the printhead 3, for example, ink cartridges 6 are mounted on the carriage 2. Each ink cartridge 6 stores ink to be supplied to the printhead 3. The ink cartridge 6 is detachable from the carriage 2. The printing apparatus PA is capable of executing color printing. Therefore, four ink cartridges which contain magenta (M), cyan (C), yellow (Y), and black (K) inks are mounted on the carriage 2. These four ink cartridges are independently detachable.

The printhead 3 includes ink orifices (nozzles) for discharging ink, and also includes a printing element substrate having electrothermal transducers (heaters) corresponding to the nozzles. A pulse voltage corresponding to a print signal is applied to each heater, and heat energy by the heater which has been applied with the pulse voltage generates bubbles in ink, thereby discharging ink from the nozzle corresponding to the heater.

Figure 1B:
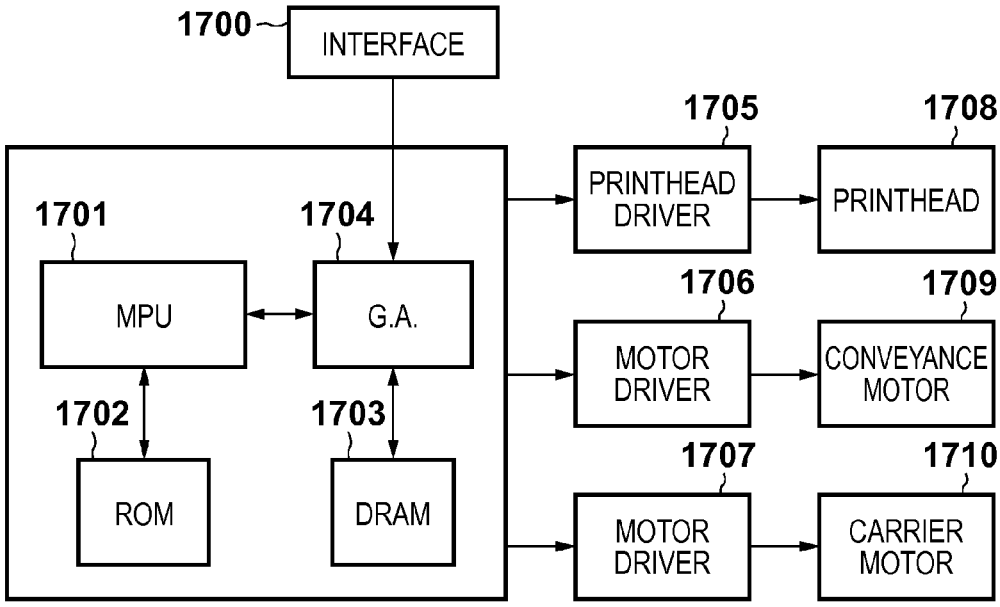

FIG. 1B exemplifies the system arrangement of the printing apparatus PA. The printing apparatus PA includes an interface 1700, an MPU 1701, a ROM 1702, a RAM 1703, and a gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls supply of print data to the printhead 1708, and also controls data transfer between the interface 1700, the MPU 1701, and the RAM 1703.

The printing apparatus PA further includes a printhead driver 1705, motor drivers 1706 and 1707, a conveyance motor 1709, and a carrier motor 1710. The printhead driver 1705 drives the printhead 1708. The motor drivers 1706 and 1707 drive the conveyance motor 1709 and carrier motor 1710, respectively. The conveyance motor 1709 conveys a printing medium. The carrier motor 1710 conveys the printhead 1708.

When a print signal is input to the interface 1700, it can be converted into print data of a predetermined format between the gate array 1704 and the MPU 1701. Each mechanism performs a desired operation in accordance with the print data, thus performing the above-described printing.

(First Embodiment)

Figure 2:
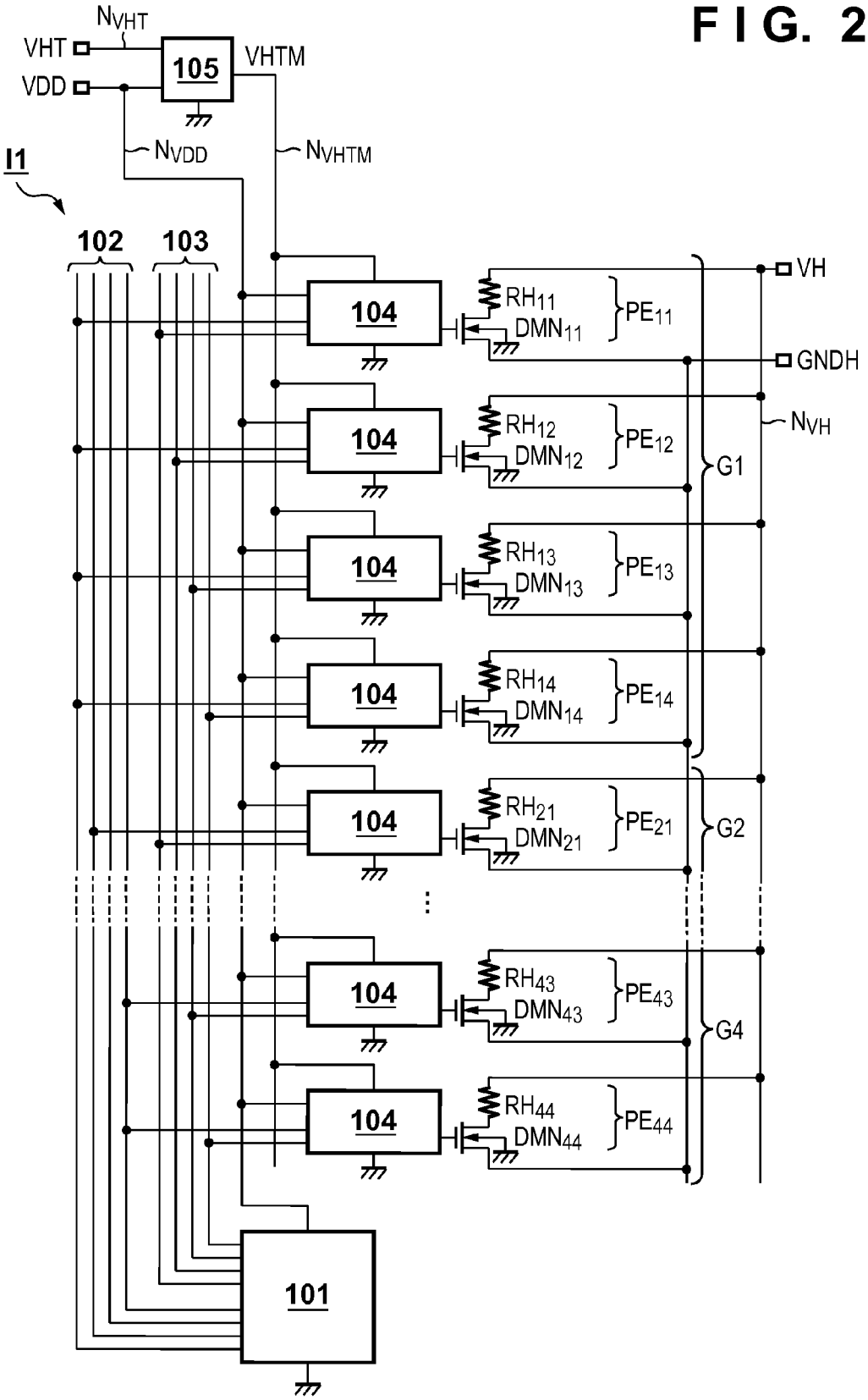
FIG. 2 is a circuit diagram for explaining an example of the arrangement of a printing element substrate.

A printing element substrate I1 according to the first embodiment will be described with reference to FIGS. 2 to 8. FIG. 2 exemplifies the circuit arrangement of the printing element substrate I1. The printing element substrate I1 includes a processing unit 101 supplied with a power supply voltage VDD to process print data, and a plurality of printing units PE supplied with a power supply voltage VH. The processing unit 101 is formed using a shift register, a latch circuit, and the like, and processes an image signal and control signal from the main body of the printing apparatus. Each printing unit PE includes a heater RH and a transistor DMN for driving the heater RH. The heater RH functions as a printing element, and is driven when the corresponding transistor DMN is rendered conductive in response to a signal from a unit 104. The transistor DMN is, for example, an n-channel MOS transistor.

The plurality of printing units PE are divided into, for example, a plurality of groups G (four groups $G_1$ to $G_4$ in this example), and each group G (for example, a kth group $G_k$) includes a plurality of printing units $PE_k$ (four printing units $PE_{k1}$ to $PE_{k4}$ in this example). With this arrangement, each printing unit PE executes printing by a so-called time-divisional driving method using a signal 102 for deciding a group G to be selected and a signal 103 for deciding a printing unit PE to be driven in each group G.

Note that an arrangement in which the number of groups is four and each group includes four printing units PE will be exemplified for the sake of simplicity. However, the number of groups G and that of printing units PE are not limited to them. For a general description, the numbers of the groups G, the numbers of the printing units PE of each group G, and the numbers of the heater RH and transistor DMN forming each printing unit PE can be omitted.

The printing element substrate 11 includes a plurality of first units 104 and a second unit 105. Each unit 104 mainly functions as a driving unit for driving the corresponding transistor DMN. For example, the unit 104 has an arrangement shown in FIG. 3 to perform the level shift of a signal from the processing unit 101 and output the signal having undergone the level shift to the gate terminal (control terminal) of the transistor DMN. Note that the level shift is an operation of converting the signal level of an input signal. For example, the potential difference (amplitude) between low level and high level is converted. In the level shift of this embodiment, a so-called level-up shift is performed to convert an input signal into a signal having an amplitude larger than that of the input signal. As the unit 104, a buffer circuit for buffering a signal from the processing unit 101 and outputting the signal to the gate terminal of the transistor DMN may be used. Note that the buffer circuit is a circuit for changing a current driving force without changing the amplitude of the input signal. The unit 105 mainly functions as a voltage generation unit for generating a constant voltage, and has, for example, an arrangement shown in FIG. 4 to generate a voltage VHTM using a power supply voltage VHT when the power supply voltage VDD is supplied. The voltage VHTM is supplied to each unit 104 as a power supply voltage (to be referred to as a power supply voltage VTHM hereinafter).

The respective power supply voltages are about, for example, VDD=3 to 5 [V], VH=24 to 32 [V], VHT=24 to 32 [V], and VHTM=12 [V]. The power supply voltages VH and VHT may be equal or different. If the power supply voltages VH and VHT are made equal to each other, it is possible to use the same power supply node or power supply line (electrically connect a power supply node $N_{VH}$ of the power supply voltage VH and a power supply node $N_{VHT}$ of the power supply voltage VHT). Since, however, the power supply node $N_{VH}$ supplies a heater current flowing to the heater RH, potential fluctuations may occur at the power supply node $N_{VH}$. Therefore, the power supply nodes $N_{VHT}$ and $N_{VH}$ are not electrically connected here (that is, these power supply wirings are separately arranged).

Figure 3:
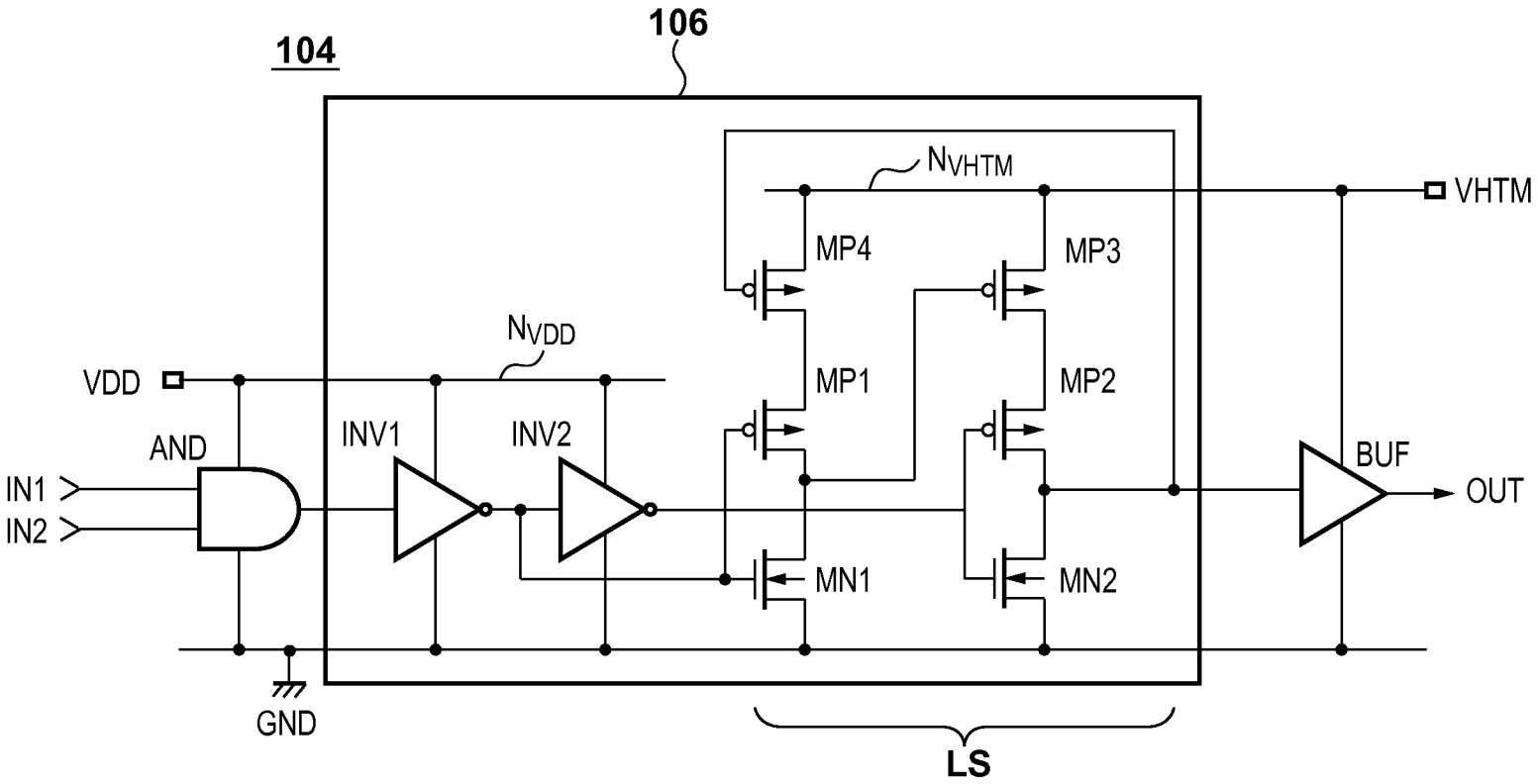
FIG. 3 is a circuit diagram for explaining an example of the arrangement of a first unit.

FIG. 3 shows an example of the arrangement of the unit 104. The unit 104 includes an AND circuit for receiving signals from inputs IN1 and IN2, a level shift unit 106 for receiving an output from the AND circuit, and performing the level shift of the output, and a buffer BUF for buffering a signal from the level shift unit 106. The level shift unit 106 includes an inverter INV1, an inverter INV2 for receiving an output from the inverter INV1, and a circuit unit LS. The power supply voltage VDD is supplied to the AND circuit and the inverters INV1 and INV2, and the power supply voltage VHTM is supplied to the circuit unit LS and the buffer BUF. The circuit unit LS receives outputs (signals of the amplitude VDD) from the inverters INV1 and INV2, and outputs a signal (a signal of the amplitude VHTM) based on the received outputs. With this arrangement, the level shift unit 106 performs the level shift of the signal of the amplitude VDD to the signal of the amplitude VHTM (converts the signal level of the input signal from VDD to VHTM).

The circuit unit LS can be formed using NMOS transistors MN1 and MN2 and PMOS transistors MP1 to MP4. The transistors MN1, MP1, and MP4 are arranged to form a current path between a ground node and a power supply node $N_{VHTM}$ to which the power supply voltage VHTM is supplied. The transistors MN2, MP2, and MP3 are arranged to form a current path between the power supply node $N_{VHTM}$ and the ground node.

The gates of the transistors MN1 and MP1 are connected to the output of the inverter INV1. The node between the transistors MN1 and MP1 is connected to the gate of the transistor MP3. The gates of the transistors MN2 and MP2 are connected to the output of the inverter INV2. The node between the transistors MN2 and MP2 is connected to the gate of the transistor MP4 and the input of the buffer BUF.

The inputs IN1 and IN2 of the unit 104 receive the signals 102 and 103. An output OUT of the unit 104, therefore, outputs a signal at the signal level VHTM when both the signals 102 and 103 are activated. The output OUT of the unit 104 is connected to the gate terminal of the transistor DMN. Note that the arrangement of the level shift unit 106 is not limited to the above-described one, and the level shift unit 106 may adopt another arrangement. Furthermore, if no level shift is performed, the circuit unit LS of the unit 104 may be omitted.

Figure 4:
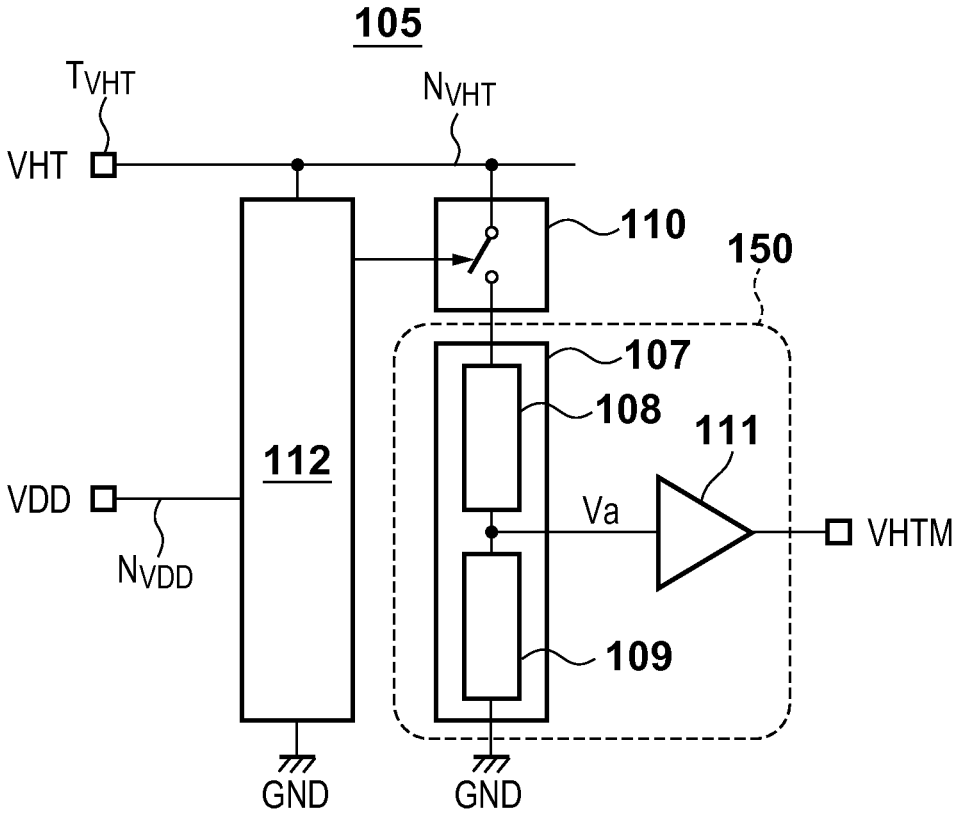
FIG. 4 is a circuit diagram for explaining an example of the arrangement of a second unit.

FIG. 4 shows an example of the arrangement of the unit 105. The unit 105 includes a terminal $T_{VHT}$ to which the power supply voltage VHT is supplied, a voltage generation unit 150 for generating the power supply voltage VHTM using the power supply voltage VHT supplied via the terminal $T_{VHT}$, and a switch unit 110 (switch). The voltage generation unit 150 includes, for example, a voltage-dividing circuit 107 formed by ohmic loads 108 and 109, and an output circuit 111 for outputting the power supply voltage VHTM based on a divided voltage Va of the voltage-dividing circuit 107. The switch unit 110 and the voltage-dividing circuit 107 are arranged between the power supply node $N_{VHT}$ and the ground node.

The unit 105 also includes a monitor unit 112 for monitoring the potential of a power supply node $N_{VDD}$ of the power supply voltage VDD. The monitor unit 112 is arranged between the power supply node $N_{VHT}$ and the ground node. The monitor unit 112 outputs a monitor result to the switch unit 110.

The switch unit 110 can function as a controlling unit for controlling supply of the power supply voltage VHT to the voltage generation unit 150 based on the monitor result of the power supply node $N_{VDD}$ by the monitor unit 112. More specifically, the monitor unit monitors the power supply node $N_{VDD}$. When the power supply voltage VDD is appropriately supplied to the processing unit 101 (more specifically, the printing element substrate 11 itself), the switch unit 110 is rendered conductive. When the switch unit 110 is rendered conductive, the power supply voltage VHT is supplied to the voltage generation unit 150, and the output of the voltage generation unit 150 becomes about 12 [V]. As a result, the potential of the power supply node $N_{VHTM}$ of the power supply voltage VHTM to be supplied to each unit 104 becomes about 12 [V], and each unit 104 enters an operation state.

On the other hand, when the power supply voltage VDD is not appropriately supplied to the processing unit 101, for example, the potential of the power supply node $N_{VDD}$ is in a floating state, a voltage supplied for the power supply node $N_{VDD}$ is lower than the power supply voltage VDD, or the like, the monitor unit renders the switch unit 110 non-conductive. When the switch unit 110 is rendered non-conductive, no power supply voltage VHT is supplied to the voltage generation unit 150 and the output of the voltage generation unit 150 becomes 0 [V]. In other case, when the switch unit 110 is rendered non-conductive, a current path from a node supplied with the power supply voltage VHT to the ground node is cut off. As a result, the potential of the power supply node $N_{VHTM}$ of the power supply voltage VHTM to be supplied to each unit 104 becomes 0 [V], and each unit 104 enters a sleep state. When the unit 104 is in the sleep state, the output OUT of the unit 104 becomes 0 [V], and thus the transistor DMN is rendered non-conductive.

Figure 5A:
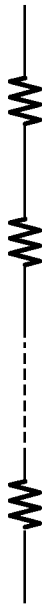
FIGS. 5A to 5D are circuit diagrams for explaining an example of the arrangement of a voltage-dividing circuit.
Figure 5B:
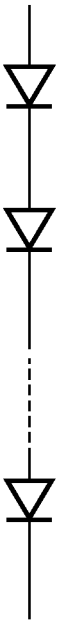
Figure 5C:
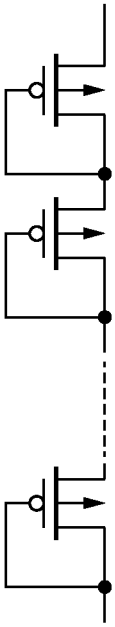
Figure 5D:
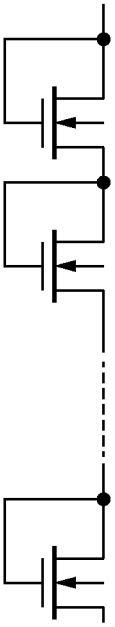

FIGS. 5A to 5D show some examples of the arrangement of the voltage-dividing circuit 107 formed by the ohmic loads 108 and 109. Known elements for forming the voltage-dividing circuit 107 need only be used as the ohmic loads 108 and 109. For example, the voltage-dividing circuit 107 may have an arrangement in which a plurality of resistance elements are series-connected, as shown in FIG. 5A. Alternatively, the voltage-dividing circuit 107 may have an arrangement in which a plurality of diodes are series-connected (by setting an anode on the power supply node side and a cathode on the ground node side), as exemplified in FIG. 5B. The voltage-dividing circuit 107 may have an arrangement in which a plurality of PMOS transistors are diode-connected in series, as exemplified in FIG. 5C, or an arrangement in which a plurality of NMOS transistors are diode-connected in series, as exemplified in FIG. 5D. Furthermore, for the voltage-dividing circuit 107, bipolar transistors may be used instead of the transistors shown in FIGS. 5C and 5D described above, or a combination of FIGS. 5A to 5D described above may be used.

FIGS. 6A to 6D show some examples of the arrangement of the output circuit 111. As exemplified in FIG. 6A, the output circuit 111 can include an operational amplifier OPAMP having a voltage follower arrangement. The operational amplifier OPAMP outputs the divided voltage Va of the voltage-dividing circuit 107 to each unit 104 as the power supply voltage VHTM. This arrangement is advantageous in stabilizing supply of the power supply voltage VHTM to each unit 104.

Figure 6A:
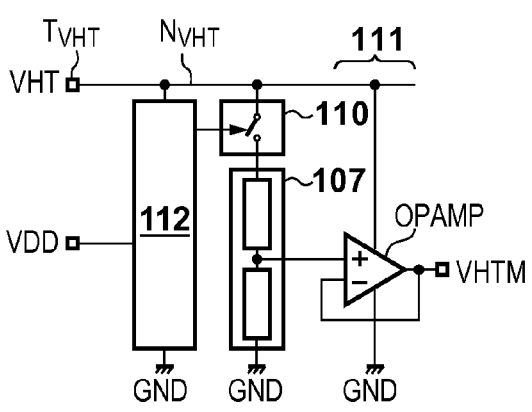
FIGS. 6A to 6D are circuit diagrams for explaining an example of the arrangement of an output circuit.
Figure 6B:
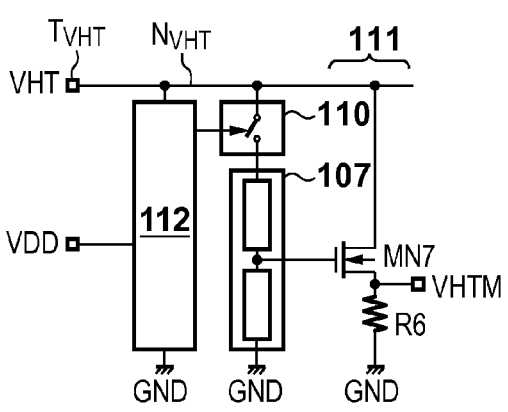
Figure 6C:
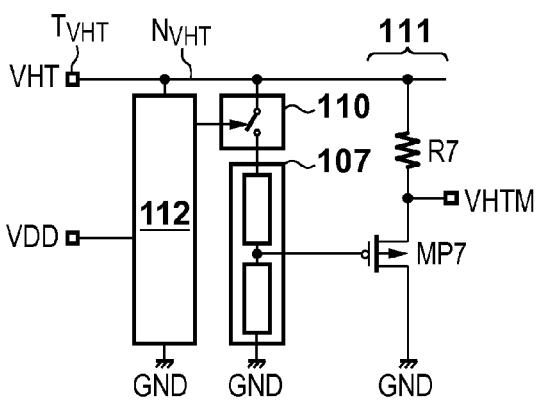
Figure 6D:
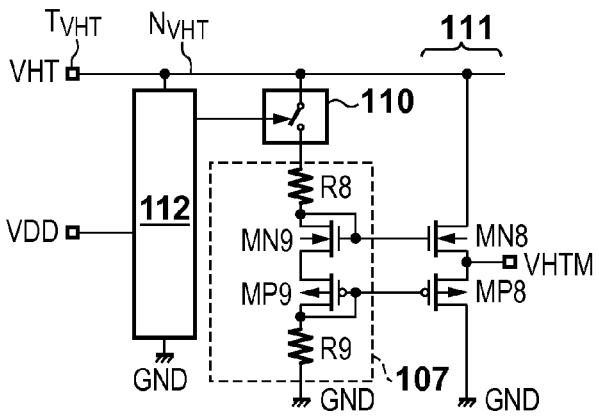

As exemplified in FIGS. 6B to 6D, the output circuit 111 can include a source follower circuit using a MOS transistor. For example, in an arrangement shown in FIG. 6B, an NMOS transistor MN7 and a resistance element R6 are used to form a source follower circuit. With this arrangement, the source potential of the transistor MN7 corresponding to the divided voltage Va of the voltage-dividing circuit 107 is output to each unit 104 as the power supply voltage VHTM. Note that an element connected to the source of the transistor MN7 need only be an ohmic load, and a diode or a diode-connected transistor may be used instead of the resistance element R6. Similarly, in an arrangement shown in FIG. 6C, a resistance element R7 and a PMOS transistor MP7 are used to form a source follower circuit.

In an arrangement shown in FIG. 6D, an NMOS transistor MN8 and a PMOS transistor MP8 are used to form a source follower circuit. In this case, the voltage-dividing circuit 107 can be formed using resistance elements R8 and R9, an NMOS transistor MN9, and a PMOS transistor MP9. These elements are arranged in the order of, for example, the resistance element R8, the diode-connected transistor MN9, the diode-connected transistor MP9, and the resistance element R9 from the side of the switch unit 110 toward the side of the ground node. The gate of the transistor MN8 is connected to the gate of the transistor MN9, and the gate of the transistor MP8 is connected to the gate of the transistor MP9. With this arrangement, it is also possible to obtain the same effects as those obtained in the arrangement shown in FIGS. 6B and 6C.

The arrangement of the output circuit 111 is not limited to the above-described arrangements shown in FIGS. 6A to 6D. The output circuit 111 may have, for example, an arrangement using a bipolar transistor, and can include, for example, an emitter follower circuit using a bipolar transistor.

Figure 7A:
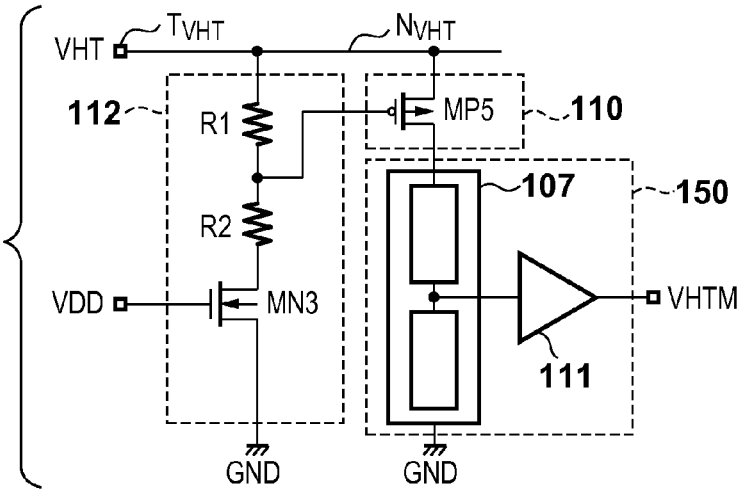
FIGS. 7A to 7C are circuit diagrams for explaining an example of the arrangement of a monitor unit.
Figure 7B:
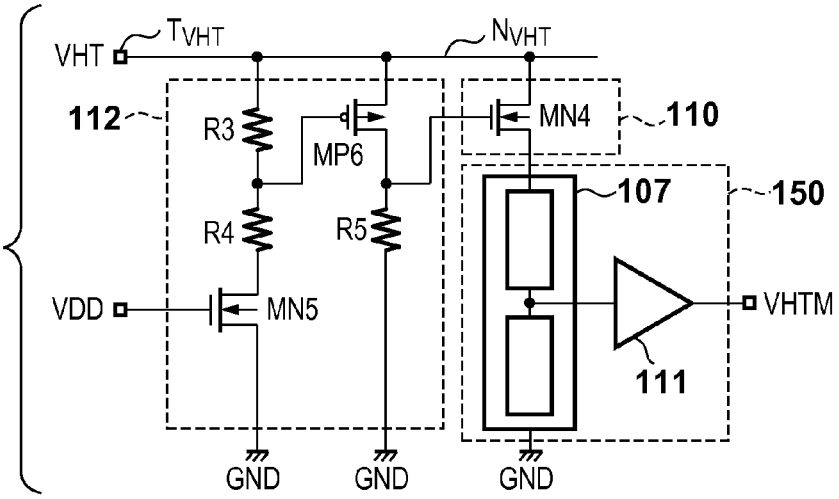
Figure 7C:
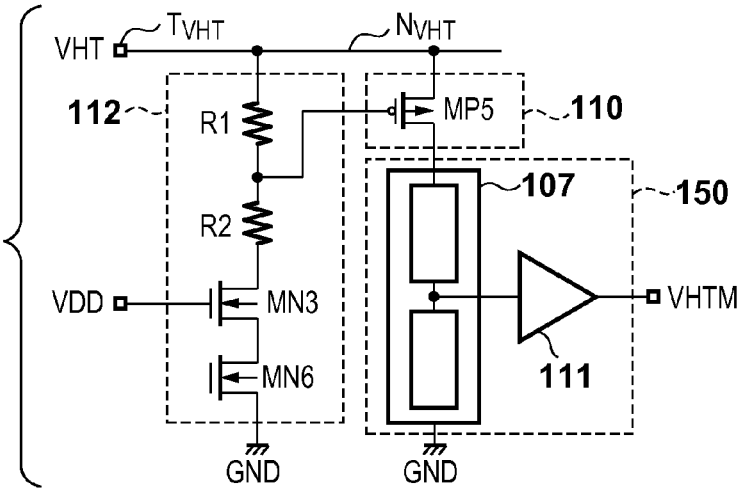

FIGS. 7A to 7C show some examples of the arrangement of the monitor unit 112. As exemplified in FIG. 7A, the monitor unit 112 may have an arrangement in which resistance elements R1 and R2 and an NMOS transistor MN3 are arranged between a power supply node $N_{VTH}$ and the ground node. In this case, a PMOS transistor MP5 is used as the switch unit 110, and the gate of the transistor MP5 need only be connected to the node between the resistance elements R1 and R2.

In the arrangement shown in FIG. 7A, the transistor MN3 functions as a monitor transistor. With this arrangement, when the power supply voltage VDD is appropriately supplied to the processing unit 101, the transistor MN3 is rendered conductive, and a divided voltage generated by the resistance elements R1 and R2 is supplied to the gate of the transistor MP5. As a result, the transistor MP5 is rendered conductive, and the power supply voltage VHT is supplied to the voltage generation unit 150. As described above, the output of the voltage generation unit 150 becomes about 12 [V], and each unit 104 enters an operation state.

On the other hand, when the power supply voltage VDD is not appropriately supplied to the processing unit 101, the transistor MN3 is rendered non-conductive, and the potential of the node between the resistance elements R1 and R2 becomes equal to the potential of the power supply node $N_{VHT}$. As a result, the transistor MP5 is rendered non-conductive, and no power supply voltage VHT is supplied to the voltage generation unit 150. As described above, the output of the voltage generation unit 150 becomes 0 [V], and each unit 104 enters a sleep state.

Note that whether the power supply voltage VDD is appropriately supplied to the processing unit 101 can be determined by comparing the potential of the power supply node $N_{VDD}$ with a predetermined reference value. With the above arrangement, for example, if the potential of the power supply node $N_{VDD}$ is higher than the threshold voltage of the transistor MN3, it can be determined that the power supply voltage VDD is appropriately supplied to the processing unit 101. If the potential of the power supply node $N_{VDD}$ is lower than the threshold voltage of the transistor MN3, it can be determined that the power supply voltage VDD is not appropriately supplied to the processing unit 101. If no power supply voltage VDD is supplied, the potential of the power supply node $N_{VDD}$ enters a floating state. In this case, although the potential of the power supply node $N_{VDD}$ can become equal to the potential of the ground node via the substrate, the power supply node $N_{VDD}$ may be pulled down and fixed using, for example, a resistance element having a large resistance value in order to avoid the indefinite state of the potential of the power supply node $N_{VDD}$.

As exemplified in FIG. 7B, the monitor unit 112 may have an arrangement in which resistance elements R3 and R4 and an NMOS transistor MN5 are arranged between the power supply node $N_{VTH}$ and the ground node, and a PMOS transistor MP6 and a resistance element R5 are arranged between the power supply node $N_{VTH}$ and the ground node. In this case, an NMOS transistor MN4 is used as the switch unit 110, and the gate of the transistor MN4 need only be connected to the node between the transistor MP6 and the resistance element R5.

In the arrangement shown in FIG. 7B, the transistor MN5 functions as a monitor transistor. With this arrangement, when the power supply voltage VDD is appropriately supplied to the processing unit 101, the transistor MN5 is rendered conductive, and a divided voltage generated by the resistance elements R3 and R4 is supplied to the gate of the transistor MP6. This renders the transistor MP6 conductive, and supplies a divided voltage generated by the transistor MP6 and the resistance element R5 to the gate of the transistor MN4. As a result, the transistor MN4 is rendered conductive, and the power supply voltage VHT is supplied to the voltage generation unit 150.

On the other hand, when the power supply voltage VDD is not appropriately supplied to the processing unit 101, the transistor MN5 is rendered non-conductive, and the potential of the node between the resistance elements R3 and R4 becomes equal to the potential of the power supply node $N_{VHT}$. With this operation, the transistor MP6 is rendered non-conductive, and the potential of the node between the transistor MP6 and the resistance element R5 becomes equal to the potential of the ground node. As a result, the transistor MN4 is rendered non-conductive, and no power supply voltage VHT is supplied to the voltage generation unit 150.

As exemplified in FIG. 7C, the monitor unit 112 may have an arrangement obtained by further providing a diode-connected NMOS transistor MN6 in the arrangement exemplified in FIG. 7A. With this arrangement, the source potential of the transistor MN3 becomes higher than the potential of the ground node, and thus the threshold voltage of the transistor MN3 shifts (becomes higher) due to the substrate bias effect. Therefore, it is also possible to adjust the determination criterion of the monitor unit 112 so as to render the transistor MN3 conductive after the power supply voltage VDD increases to the extent that each unit which operates by receiving the power supply voltage VDD is sufficiently operable. This can prevent an operation error of the unit 104 or printing unit PE, and also prevent damage to the heater RH caused by the operation error.

Note that although the arrangement in which the transistor MN6 is added has been exemplified, the present invention is not limited to this, and two or more transistors may be added. Furthermore, in the arrangement shown in FIG. 7C, the same operation as that in the arrangement shown in FIG. 7A is performed.

In the unit 105 with the above arrangement, the monitor unit 112 monitors the potential of the power supply node $N_{VDD}$, the switch unit 110 supplies the power supply voltage VHT to the voltage generation unit 150 based on the monitor result, and the voltage generation unit 150 generates the power supply voltage VHTM using the supplied power supply voltage VHT. That is, the unit 105 has two operation modes. When the power supply voltage VDD is appropriately supplied to the processing unit 101 (more specifically, the printing element substrate 11 itself), the unit 105 operates in the first mode in which the power supply voltage VHTM is supplied to each unit 104. Alternatively, when the power supply voltage VDD is not appropriately supplied to the processing unit 101, the unit 105 operates in the second mode in which no power supply voltage VHT is supplied to the voltage generation unit 150. Furthermore, when the power supply voltage VDD is not appropriately supplied to the processing unit 101 (in the second mode), the switch unit 110 is rendered non-conductive, and no power supply voltage VHT is supplied to the voltage generation unit 150. Consequently, the voltage generation unit 150 supplies no power supply voltage VHTM to each unit 104, and each unit 104 enters a sleep state, thereby preventing an operation error of the unit 104 or printing unit PE. At this time, since the switch unit 110 is non-conductive, and the transistor of the monitor unit 112, which receives the power supply voltage VDD, is also non-conductive, the current path between the power supply node $N_{VHT}$ and the ground node is cut off. Therefore, this embodiment is advantageous in preventing an operation error of the unit 104 or printing unit PE, and reducing the power consumption.

Note that the power supply voltage VH or VHT as a high voltage (24 to 32 [V]) is used to appropriately operate each of the aforementioned units, as described above. DMOS transistors as high-breakdown voltage transistors, therefore, can be used as the respective transistors of the unit 105 and the transistor DMN (to be described later).

(Second Embodiment)

Figure 8:
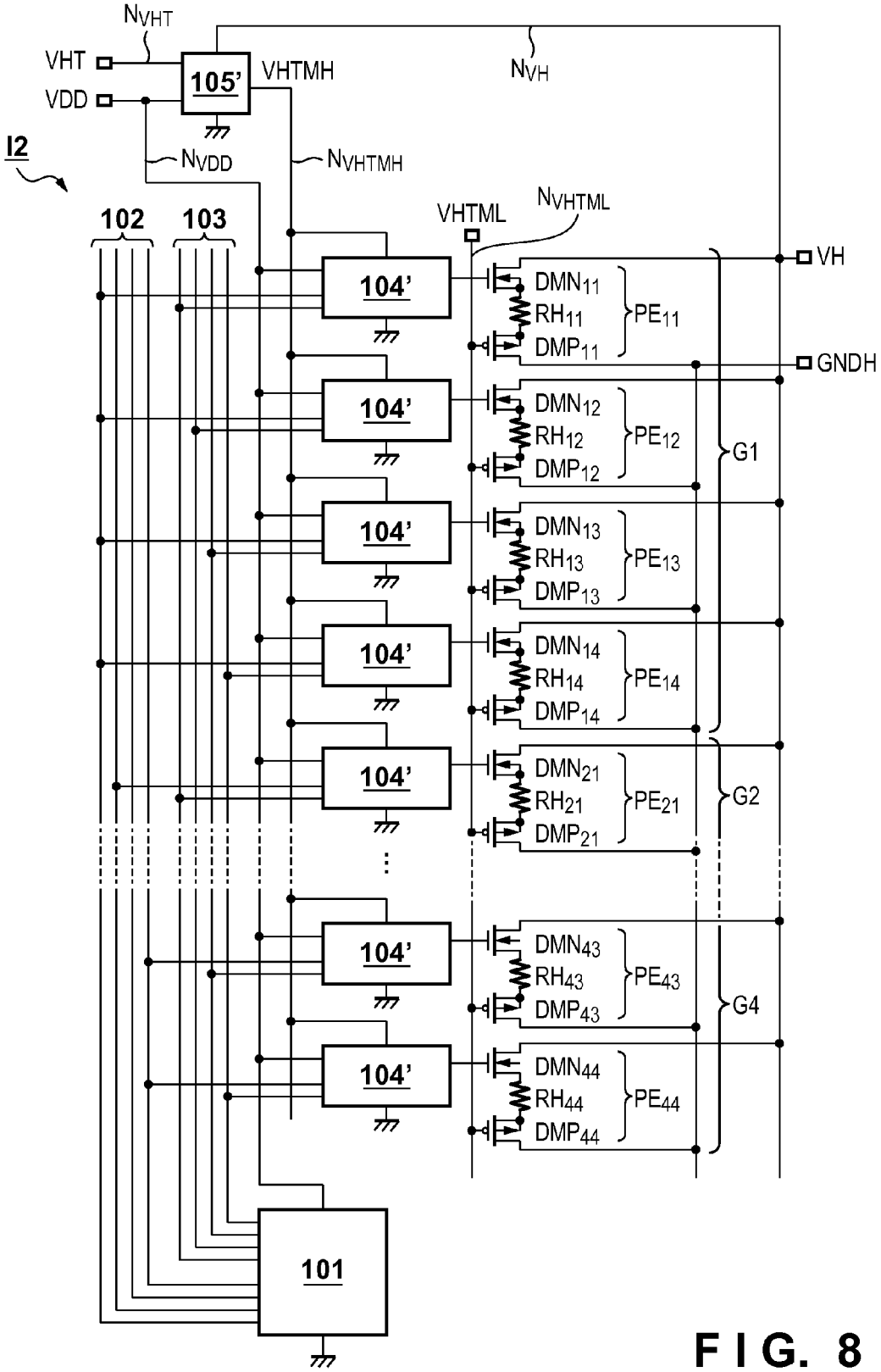
FIG. 8 is a circuit diagram for explaining another example of the arrangement of the printing element substrate.

A printing element substrate 12 according to the second embodiment will be described with reference to FIGS. 8 and 9. FIG. 8 exemplifies the circuit arrangement of the printing element substrate 12. In this embodiment, the arrangements of a printing unit PE' and a unit 105' are mainly different from those of the printing unit PE and unit 105 of the first embodiment.

The printing unit PE' includes a heater RH, an NMOS transistor DMN for controlling the driving of the heater RH, and a PMOS transistor DMP whose gate is connected to a power supply node $N_{VHTML}$ of a power supply voltage VHTML. While the transistor DMN is conductive and drives the heater RH, the source potential of the transistor DMN complies with the gate potential by a source follower operation, and the potential of one terminal of the heater RH changes to the source potential. With respect to the transistor DMP, the power supply voltage VHTML is a constant voltage, the source potential of the transistor DMP complies with the gate potential by a source follower operation, and the potential of the other terminal of the heater RH changes to the source potential. In the printing unit PE', the transistors DMN and DMP are configured so that a constant current is supplied to the heater RH even if potential fluctuations occur at a power supply node $N_{VH}$ and a ground node.

The unit 105' monitors the potential of the power supply node $N_{VH}$ of a power supply voltage VH in addition to the potential of a power supply node $N_{VDD}$ of a power supply voltage VDD. A power supply voltage VHTMH corresponds to the power supply voltage VHTM in the first embodiment, and is generated by the unit 105' and supplied to units 104. When the power supply voltage VDD and a power supply voltage VH are appropriately supplied to the printing element substrate 12, the unit 105' supplies the power supply voltage VHTMH (=about 12 [V]) to each unit 104. When at least one of the power supply voltages VDD and VH is not appropriately supplied, the unit 105' supplies no power supply voltage VHT to a voltage generation unit 150 (the unit 105' outputs 0 [V]).

Figure 9:
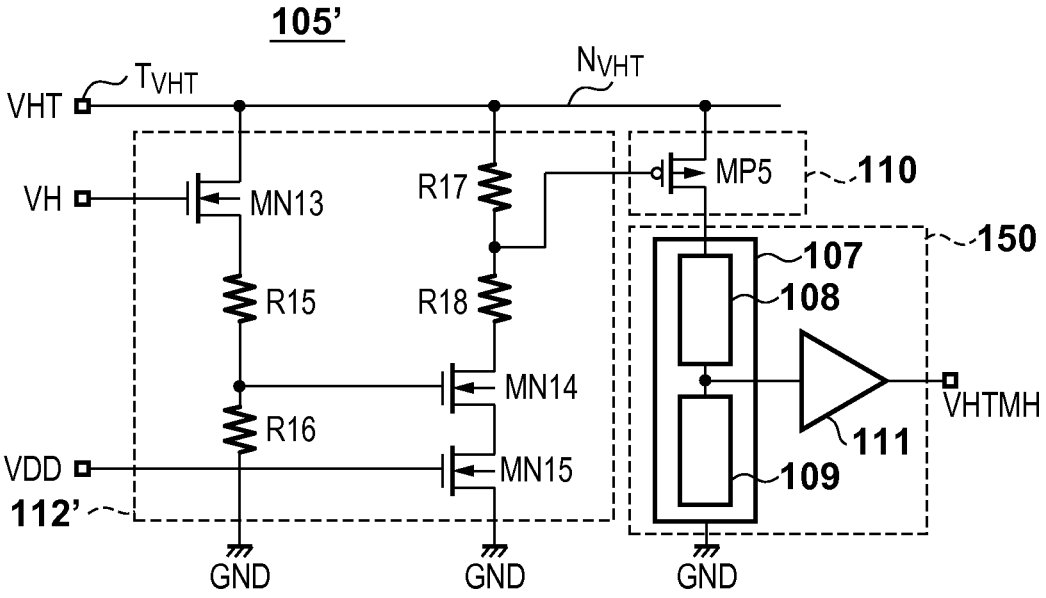
FIG. 9 is a circuit diagram for explaining another example of the arrangement of the second unit.

FIG. 9 shows an example of the arrangement of the unit 105'. The arrangement of the unit 105' is mainly different from that in the first embodiment in that a monitor unit 112' monitors the power supply node $N_{VH}$ in addition to the power supply node $N_{VDD}$. Resistance elements R15 to R18 and NMOS transistors MN13 to MN15 can be used for the monitor unit 112'. More specifically, the transistor MN 13 and the resistance elements R15 and R16 are arranged to form a current path between a power supply node $N_{VHT}$ and the ground node, and the resistance elements R17 and R18 and the transistors MN14 and MN15 are arranged to form a current path between the power supply node $N_{VHT}$ and the ground node. The power supply node $N_{VH}$ is connected to the gate of the transistor MN13. The power supply node $N_{VDD}$ is connected to the gate of the transistor MN15.

With the above arrangement, when the power supply voltages VDD and VH are appropriately supplied to the printing element substrate 12, a transistor MP5 of a switch unit 110 is rendered conductive, and the output of the unit 105' becomes about 12 [V]. On the other hand, when at least one of the power supply voltages VDD and VH is not appropriately supplied to the printing element substrate 12, the transistor MP5 of the switch unit 110 is rendered non-conductive, and the output of the unit 105' becomes 0 [V]. Note that in this case, no power supply voltage VHTMH is supplied to each unit 104. Each unit 104 enters a sleep state (an output OUT of each unit 104 becomes 0 [V]), and thus the transistor DMN is rendered non-conductive, as described above.

That is, according to this embodiment, the unit 105' monitors the potential of the power supply node $N_{VH}$ of the power supply voltage VH in addition to the potential of the power supply node $N_{VDD}$ of the power supply voltage VDD. When the power supply voltages VDD and VH are appropriately supplied to the printing element substrate 12, the unit 105' operates in the first mode in which the power supply voltage VHTMH (=about 12 [V]) is supplied to each unit 104. On the other hand, when at least one of the power supply voltages VDD and VH is not appropriately supplied, the unit 105' operates in the second mode in which no power supply voltage VHT is supplied to the voltage generation unit 150. Alternatively, when neither of the power supply voltages VDD and VH is appropriately supplied to the printing element substrate 12, the switch unit 110 is rendered non-conductive, and no power supply voltage VHT is supplied to the voltage generation unit 150. In this embodiment, therefore, it is also possible to obtain the same effects as those in the first embodiment.

Note that the power supply voltage VH or VHT as a high voltage (24 to 32 [V]) is used to appropriately operate each of the aforementioned units, as described above. DMOS transistors as high-breakdown voltage transistors, therefore, can be used as the respective transistors of the unit 105' and the transistor DMN.

(High-Breakdown Voltage Transistor)

Figure 10A:
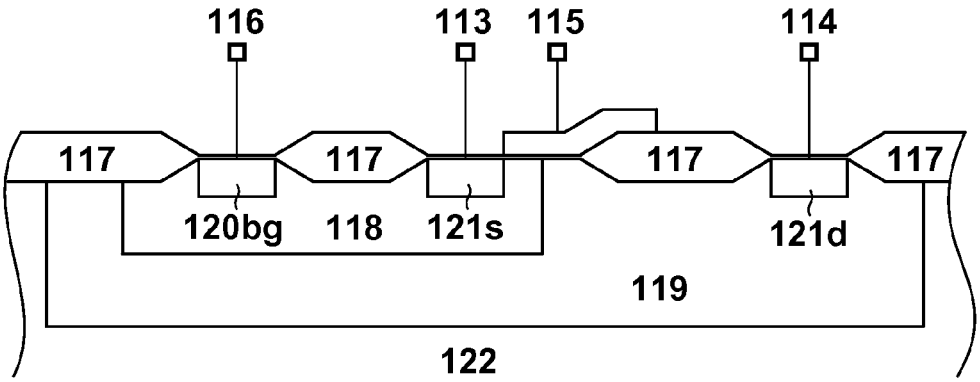
FIGS. 10A to 10C are views for explaining an example of the arrangement of a high-breakdown voltage transistor.
Figure 10B:
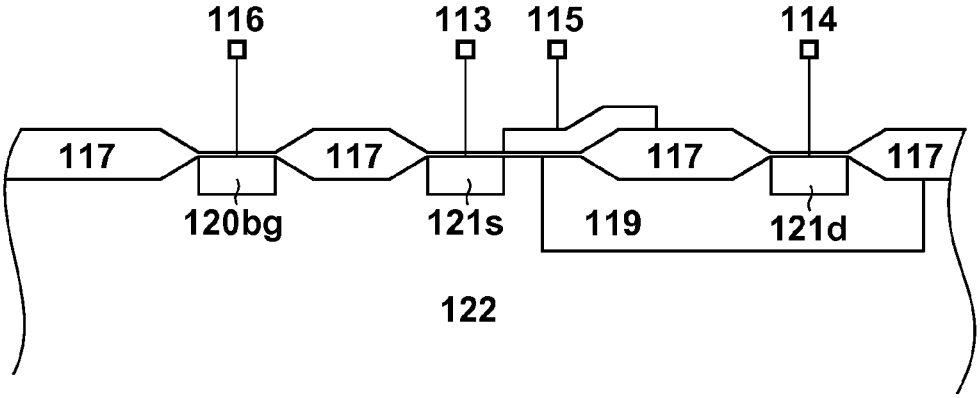
Figure 10C:
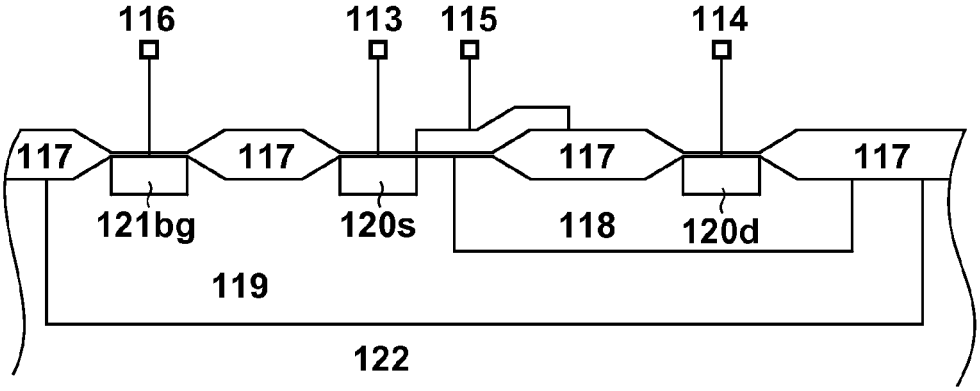

FIGS. 10A to 10C show some examples of the arrangement of the DMOS transistor as a high-breakdown voltage transistor used in each of the above-described embodiments. Each of FIGS. 10A and 10B shows an example of the arrangement of an n-channel DMOS transistor, and FIG. 10C shows an example of the arrangement of a p-channel DMOS transistor. The arrangement of the DMOS transistor exemplified here can be formed using a known semiconductor manufacturing process.

In FIG. 10A, an n-type semiconductor region 119 is formed in a substrate including a p-type semiconductor region 122, and a p-type semiconductor region 118 is formed in the n-type semiconductor region 119. A heavily doped p-type region 120*bg* is formed in the p-type semiconductor region 118. A heavily doped n-type region 121*s* is also formed in the p-type semiconductor region 118. A heavily doped n-type region 121*d* is formed at a position away from the p-type semiconductor region 118 in the n-type semiconductor region 119. Insulating films including a field oxide film 117 and a gate insulating film are formed on the substrate. Furthermore, a gate electrode is formed on the field oxide film 117 and the gate insulating film in a boundary region between the p-type semiconductor region 118 and the n-type semiconductor region 119. A terminal 113 corresponds to a source terminal, a terminal 114 corresponds to a drain terminal, a terminal 115 corresponds to a gate terminal, and a terminal 116 corresponds to a back gate terminal (bulk terminal). This arrangement reduces the electric field from the n-type region 121*d* corresponding to a drain region to the gate electrode and a channel, and thus the transistor can function as a high-breakdown voltage transistor.

The arrangement shown in FIG. 10B is different from that shown in FIG. 10A in that the p-type region 120*bg* and the n-type region 121*s* are not electrically isolated from the p-type semiconductor region 122. Therefore, to electrically isolate the source and the back gate from the ground node, the arrangement shown in FIG. 10A can be adopted. On the other hand, to electrically connect the source and the back gate to the ground node, the arrangement shown in FIG. 10B can be adopted. Especially, in the arrangement shown in FIG. 10A, for example, when causing a high current which drives the heater RH to flow, the source potential rises, thereby preventing a gate-source insulation breakdown.

In FIG. 10C, the p-type semiconductor region 118 is formed in the n-type semiconductor region 119. A heavily doped n-type region 121*bg* and a heavily doped p-type region

120*s* are formed at a position away from the p-type semiconductor region 118 in the n-type semiconductor region 119. Furthermore, a heavily doped p-type region 120*d* is formed in the p-type semiconductor region 118. With this arrangement, the transistor can function as a high-breakdown voltage transistor, similarly to FIGS. 10A and 10B.

Although the two embodiments have been described above, the present invention is not limited to them. The embodiments can be appropriately changed or combined in accordance with the purpose, state, application, function, and other specifications, and the present invention can also be implemented by another embodiment. For example, an arrangement using a heater (electrothermal transducer) as a printing element has been exemplified in each of the above-described embodiments, but a printing method using a piezoelectric element or another known printing method may be adopted. Furthermore, for example, each parameter (a voltage value or the like) can be changed in accordance with the specification and application, and each unit can be accordingly changed so as to appropriately operate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-156031, filed Jul. 26, 2013, which is hereby incorporated by reference herein in its entirety.

What is claimed is:

1. A substrate comprising:

a discharging unit including an element configured to discharge liquid from a nozzle and a transistor configured to drive the element;

a logic circuit unit configured to be supplied with a first power supply voltage and to receive data;

a unit configured to be supplied with a second power supply voltage and to output a signal from the logic circuit unit to a control terminal of the transistor;

a voltage generation unit configured to be supplied with a third power supply voltage and to generate, using the third power supply voltage, the second power supply voltage to be supplied to the unit;

a monitor unit configured to be supplied with the third power supply voltage to monitor a potential of a node supplied with the first power supply voltage; and a controlling unit configured to control supply of the third power supply voltage to the voltage generation unit, wherein when a monitor result by the monitor unit indicates that the first power supply voltage is not supplied to the logic circuit unit, the controlling unit does not supply the third power supply voltage to the voltage generation unit.

2. The substrate according to claim 1, wherein the voltage generation unit includes a voltage-dividing circuit arranged between a ground node and a node supplied with the third power supply voltage, and an output circuit configured to output a voltage based on a divided voltage of the voltage-dividing circuit.

3. The substrate according to claim 2, wherein the output circuit includes one of an operational amplifier having a voltage follower arrangement, a source follower circuit using a MOS transistor, and an emitter follower circuit using a bipolar transistor.

4. The substrate according to claim 2, wherein the voltage-dividing circuit is formed using a plurality of elements series-connected, and each of the plurality of elements includes at least one of a resistance element, a diode, and a transistor.

5. The substrate according to claim 1, wherein when the voltage generation unit does not supply the second power supply voltage, the unit renders the transistor non-conductive.

6. A printhead comprising:

a substrate defined in claim 1; and an ink orifice arranged to correspond to an element and configured to discharge ink in response to driving of the element.

7. A printing apparatus comprising:

a printhead defined in claim 6; and a printhead driver configured to drive the printhead.

8. A substrate comprising:

a discharging unit including an element configured to discharge liquid from a nozzle and a transistor configured to drive the element;

a logic circuit unit configured to be supplied with a first power supply voltage and to receive data;

a unit configured to be supplied with a second power supply voltage and to output a signal from the logic circuit unit to a control terminal of the transistor;

a voltage generation unit configured to be supplied with a third power supply voltage and to generate, using the third power supply voltage, the second power supply voltage to be supplied to the unit;

a controlling unit configured to control supply of the third power supply voltage to the voltage generation unit, wherein when the first power supply voltage is not supplied to the logic circuit unit, the controlling unit does not supply the third power supply voltage to the voltage generation unit; and a monitor unit configured to monitor a potential of a node supplied with the first power supply voltage, wherein the controlling unit selects not to supply the third power supply voltage to the voltage generation unit based on a monitor result by the monitor unit.

9. The substrate according to claim 8, wherein the monitor unit includes a monitor transistor, and when the first power supply voltage is not supplied, the monitor transistor is rendered non-conductive to cut off a current path from a node supplied with the third power supply voltage to a ground node.

10. The substrate according to claim 8, wherein the controlling unit includes a switch configured to operate based on the monitor result.

11. The substrate according to claim 10, wherein the switch is arranged between the voltage generation unit and a node supplied with the third power supply voltage.

12. The substrate according to claim 8, wherein the monitor unit further monitors a potential of a power supply node of a power supply voltage supplied to the element.

13. A substrate comprising:

a discharging unit including an element configured to discharge liquid from a nozzle and a transistor configured to drive the element;

a logic circuit unit configured to be supplied with a first power supply voltage and to receive data;

a unit configured to be supplied with a second power supply voltage and to output a signal from the logic circuit unit to a control terminal of the transistor;

a voltage generation unit having a node to which a third power supply voltage is supplied, and configured to generate, using the third power supply voltage, the second power supply voltage to be supplied to the unit;

a monitor unit configured to monitor a potential of a node supplied with the first power supply voltage; and a controlling unit configured to cut off a current path between the node and a ground node based on a monitor result by the monitor unit.

14. A printhead comprising:

a substrate defined in claim 13; and an ink orifice arranged to correspond to an element and configured to discharge ink in response to driving of the element.

15. A printing apparatus comprising:

a printhead defined in claim 14; and a printhead driver configured to drive the printhead.

16. A printhead comprising:

a substrate defined in claim 8; and an ink orifice arranged to correspond to an element and configured to discharge ink in response to driving of the element.

17. A printing apparatus comprising:

a printhead defined in claim 16; and a printhead driver configured to drive the printhead.

18. A substrate comprising:

a discharging unit including an element configured to discharge liquid from a nozzle and a transistor configured to drive the element;

a logic circuit unit configured to be supplied with a first power supply voltage and to receive data;

a unit configured to be supplied with a second power supply voltage and to output a signal from the logic circuit unit to a control terminal of the transistor;

a voltage generation unit configured to be supplied with a third power supply voltage and to generate, using the third power supply voltage, the second power supply voltage to be supplied to the unit, the voltage generation unit including a switch and a voltage-dividing circuit which are serially connected to each other between a node supplied with the third power supply voltage and a ground node; and a controlling unit configured to control the switch to be turned off when the first power supply voltage is not supplied to the logic circuit unit.

19. The substrate according to claim 18, wherein the voltage-dividing circuit includes a first resistor and a second resistor which are serially connected to each other between the switch and the ground node.

20. The substrate according to claim 19, wherein the voltage-dividing circuit includes an output unit connected to a node between the first resistor and the second resistor.

* * * * *